US007762183B2

(12) United States Patent
Lucchesi

(10) Patent No.: US 7,762,183 B2
(45) Date of Patent: Jul. 27, 2010

(54) METHOD AND DEVICE FOR MARKING AN OPHTHALMIC LENS

(75) Inventor: Moreno Lucchesi, Mamey (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 786 days.

(21) Appl. No.: 11/628,156

(22) PCT Filed: May 31, 2005

(86) PCT No.: PCT/FR2005/001330

§ 371 (c)(1),
(2), (4) Date: Feb. 28, 2007

(87) PCT Pub. No.: WO2006/000683

PCT Pub. Date: Jan. 5, 2006

(65) Prior Publication Data

US 2007/0251401 A1 Nov. 1, 2007

(30) Foreign Application Priority Data

Jun. 3, 2004 (FR) ..... 04 06013

(51) Int. Cl.
*B41F 17/30* (2006.01)
*B41M 1/26* (2006.01)

(52) U.S. Cl. ..... 101/41; 101/163; 101/170; 351/177

(58) Field of Classification Search ..... 101/41
See application file for complete search history.

(56) References Cited

U.S. PATENT DOCUMENTS

| | | | | |
|---|---|---|---|---|
| 3,916,784 | A * | 11/1975 | Dubuit | 101/41 |
| 4,683,821 | A * | 8/1987 | Berberich | 101/170 |
| 4,738,198 | A * | 4/1988 | Sillner | 101/44 |
| 4,738,199 | A * | 4/1988 | Chen | 101/163 |
| 4,745,857 | A * | 5/1988 | Putnam et al. | 101/44 |
| 6,393,981 | B1 | 5/2002 | Cameron | |
| 6,837,580 | B2 | 1/2005 | Senda et al. | |

FOREIGN PATENT DOCUMENTS

| | | |
|---|---|---|
| DE | 3717179 | 5/1987 |
| FR | 2701666 | 2/1993 |
| JP | 58110253 | 6/1983 |

* cited by examiner

*Primary Examiner*—Jill E Culler
(74) *Attorney, Agent, or Firm*—Young & Thompson

(57) ABSTRACT

A method for marking an ophthalmic lens according to predetermined patterns includes supplying a plate (1) provided with engravings (4), filling the engravings (4) with marking ink, applying a pad (7) to the engravings (4), applying the pad (7) to the ophthalmic lens (5). The method involves a stage for pre-preparing the pad (7) in such a way that at least two movable with respect to each other inking portions (12, 13) are defined and a transformation stage for modifying the arrangement of the inking portions (12, 13) which is carried out between the stage for applying the pad (7) to the plate (1) and the stage for applying the inked pad to the lens (5).

20 Claims, 7 Drawing Sheets

METHOD AND DEVICE FOR MARKING AN OPHTHALMIC LENS

FIELD OF THE INVENTION

The invention relates to the general field of marking ophthalmic lenses.

It concerns more particularly a method and a device for depositing ink onto an ophthalmic lens in accordance with predetermined shapes.

BACKGROUND OF THE INVENTION

The fabrication processes generally employed to obtain a finished ophthalmic lens trimmed to the shape of a particular frame typically include steps during which the ophthalmic lens receives markings on its surface. For example, the lens may receive dots or crosses identifying a particular point (for example the optical center of the ophthalmic lens), axis lines (for example to indicate the axis on which astigmatism is corrected), shapes delimiting a particular area (for example near vision area or distant vision area in the case of progressive ophthalmic lenses). Likewise, it may be necessary to effect markings relating to the identification of the ophthalmic lens or other commercial markings.

Of the diverse technologies for causing a mark to appear on the surface of an ophthalmic lens, marking with the aid of an inked pad applied to said surface is routinely employed for its low operating cost and its marking accuracy.

Thus there are known processes for depositing ink onto an ophthalmic lens during which an ophthalmic lens is disposed on a support in the vicinity of a plate with engravings reproducing the shapes to be printed on the lens, this plate being commonly referred to as a "printing plate".

The printing plate and the ophthalmic lens are both accessible to an elastically deformable pad, generally of silicone. The pad is first applied to the surface of the printing plate after it has been inked (i.e. after the engravings on the printing plate have been filled with ink). The pad is then moved away from the surface of the printing plate, the ink contained in the engravings adhering to the pad to form an inked pad.

The inked pad is then applied to the surface of the ophthalmic lens to be marked and the ink disposed in the engravings on the printing plate is then transferred from the pad to the surface of the ophthalmic lens.

A method of printing markings on a progressive ophthalmic lens is also known from the document US 2003/0107704. This method deposits on an ophthalmic lens a pattern that includes a graduated portion.

This method can therefore be used to print the same pattern on progressive ophthalmic lenses with different characteristics. The graduations are used afterwards to identify particular points specific to each type of lens.

Thanks to this method, it is therefore not necessary to have a marking specific to each of the types of progressive ophthalmic lenses.

SUMMARY OF THE INVENTION

The object of the invention is to improve this type of ophthalmic lens printing method.

To this end, the invention is directed to a method of marking an ophthalmic lens according to predetermined patterns, this method including the following steps:

- provision of a plate having engravings reproducing said predetermined patterns according to a first arrangement;
- filling of said engravings with a marking ink;

- application of a pad to the engravings on said plate so that the ink contained in the engraving adheres to the pad to form an inked pad carrying said patterns according to the first arrangement;
- application of the inked pad to an ophthalmic lens, in such a manner as to deposit thereon the ink disposed in accordance with said predetermined patterns;

this method being characterized in that it includes a prior step of preparation of the pad so as to delimit at least two inking portions mobile one relative to the other and in that it further includes, between the step of application of the pad to the plate and the step of application of the inked pad to the lens, a transformation step during which the arrangement of the inking portions is modified by relative displacement of said inking portions to determine a second arrangement of said patterns whereby the patterns are deposited on the lens according to the second arrangement.

Starting with only one printing plate, such a method enables the printing of different sizes or shapes of patterns by a single application of the pad to the ophthalmic lens, starting from an initial pattern on the printing plate.

Thus a single printing plate can be used to print lenses with different characteristics.

For example, to each type of progressive ophthalmic lens there corresponds a specific marking in which the marking identifying the distant vision area is positioned very accurately relative to the marking identifying the near vision area.

If the "distant vision" marking is carried by one of the portions of the surface of the pad and the "near vision" marking is carried by another portion of the surface of the pad, the relative position of these two markings can be adjusted for each type of ophthalmic lens.

Each lens receives the marking that is specific to it and not a universal graduated marking that necessitates a subsequent step of reading the graduations.

This method may be implemented with the following preferred features:

- the relative displacement of said inking portions is effected by displacing one of the inking portions using an actuator;
- the second arrangement of the patterns is determined by positioning one of the inking portions against abutments;
- the method further includes a step of adjustment of said abutments before the positioning of the inking portion;
- said step of adjustment of the abutments is effected simultaneously with other steps;
- during the step of application of the pad to the engravings, the inking of the pad by all of said engravings is effected.

According to one embodiment, the marking method further includes, between the step of filling of the engravings and the step of application of the pad to the engravings, a configuration step during which the arrangement of the inking portions is modified by relative displacement of said inking portions to feature a predetermined inking arrangement of said patterns thanks to which the patterns carried by the inked pad are deposited according to said inking arrangement.

During the step of application of the pad to the engravings, the inking of the pad may be effected by only some of said engravings, said inking arrangement of the pad enabling selection of engravings for inking the pad.

A method according to this embodiment enables the use of a printing plate having an area with engravings common to different predetermined patterns as well as areas with specific engravings. Before inking the pad, the two inking portions are first positioned relative to each other so that said area with common engravings inks one of the inking portions whereas a chosen specific area inks the other inking portion.

After inking, the transformation step enables the pad to reconstitute the predetermined patterns to be applied to a lens.

Thus a single printing plate having a common inking area and specific inking areas may be used to deposit on different lenses different patterns having a common area, rather than a multitude of specific printing plates.

The invention also consists of a device for marking an ophthalmic lens in accordance with predetermined patterns, this device being adapted to implement the method described above and including:

- a support for receiving a plate with engravings reproducing said predetermined patterns according to a first arrangement;
- a support for receiving an ophthalmic lens;
- a device for inking the plate;
- a pad having an inking surface through which it is adapted to be moved selectively opposite the first support in an inking position or the second support in a marking position;

this device being characterized in that the pad includes at least two inking portions mobile the one relative to the other and in that a displacement drive member is provided for displacing said inking portions between the inking position and the marking position, thanks to which the pad is adapted to be inked with said patterns disposed according to the first arrangement, said patterns being adapted to be disposed according to a second arrangement in the marking position.

The device may equally be implemented with the following preferred features:

- a first of said inking portions is coupled to a first rigid member and a second of said inking portions is coupled to a second rigid member, the first rigid member and the second rigid member being adapted to be displaced the one relative to the other, and in that said displacement drive member acts on at least one of the rigid members;
- the first inking portion is mounted on a fixed support and the second inking portion is mounted on a mobile support;
- the mobile support is adapted to be driven by an actuator;
- the mobile support is adapted to cooperate with fixed abutments;
- the mobile support is adapted to cooperate with mobile abutments;
- the first inking portion and the second inking portion are mounted on the same fixed support, the second portion being made from an elastically deformable material and being coupled to a rigid bar mobile relative to said fixed support;
- said rigid bar is attached to the fixed support by a ball-joint;
- said rigid bar is adapted to be driven by an actuator; and
- the first inking portion and the second inking portion are made of silicone.

BRIEF DESCRIPTION OF THE DRAWINGS

Other features and advantages of the invention become apparent in the light of the following description of a preferred embodiment given by way of nonlimiting example, description given with reference to the appended drawings, in which.

DETAILED DESCRIPTION OF THE INVENTION

Figure 1:
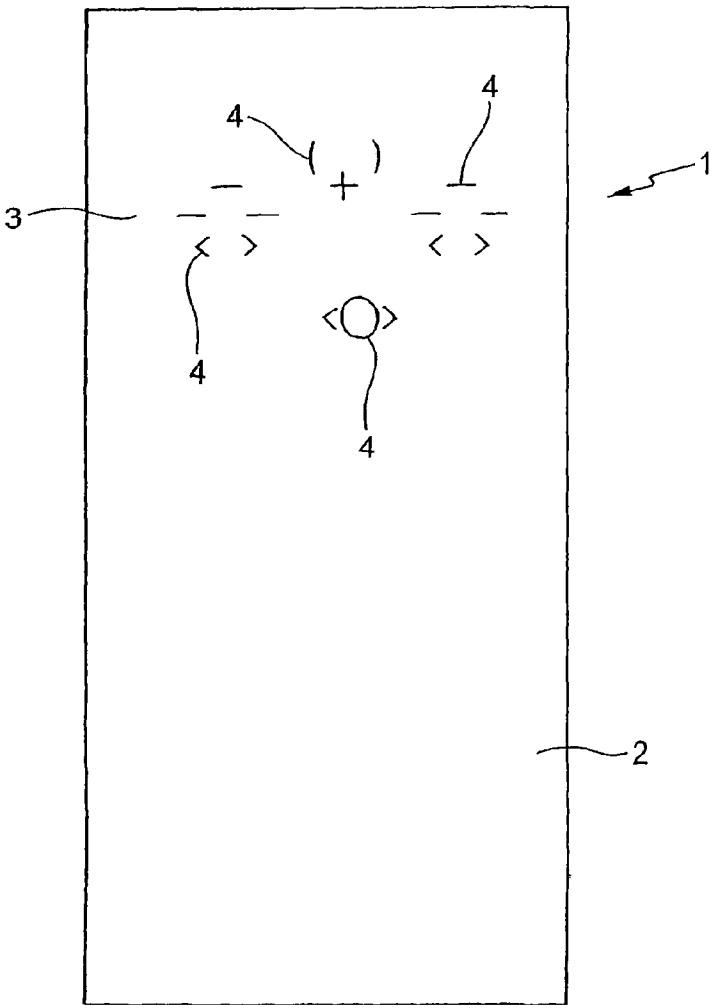
FIG. 1 represents a printing plate seen from above including visible engravings.

FIG. 1 shows the surface of an inking plate 1 intended to cooperate with a pad, this plate being commonly called a "printing plate".

This printing plate 1 has a plane and smooth surface 2 (that visible in this FIG. 1), optionally varnished, and which includes an inking area 3.

In this inking area 3, engravings 4 are made on the surface 2. Each pattern visible on the printing plate 1 in FIG. 1 corresponds to one of these engravings 4 and may be effected, for example, by machining or by a chemical process for removing material.

Figure 2:
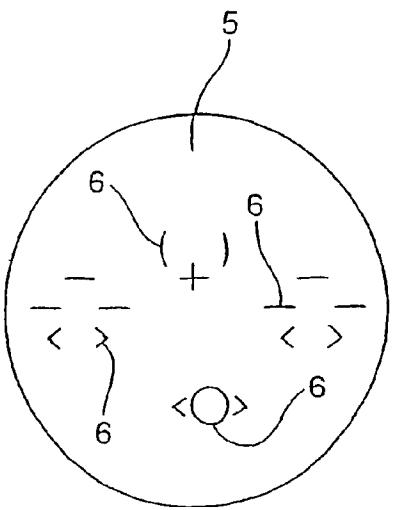
FIG. 2 is an ophthalmic lens seen from above after markings have been printed on its surface from the FIG. 1 printing plate.

FIG. 2 represents an ophthalmic lens 5 seen from above. This lens is, in the present example, a raw lens that has not yet been trimmed, that is to say machined to the shape of a particular frame, which explains its circular shape.

The ophthalmic lens 5 has on one of its faces markings 6 produced with ink and reproducing the disposition of the engravings 4 on the printing plate 1 from FIG. 1. The ophthalmic lens 5 has in fact received the markings 6 by the application of a previously inked pad to the inking area 3 of the printing plate 1, in accordance with the method explained hereinafter.

Figure 3:
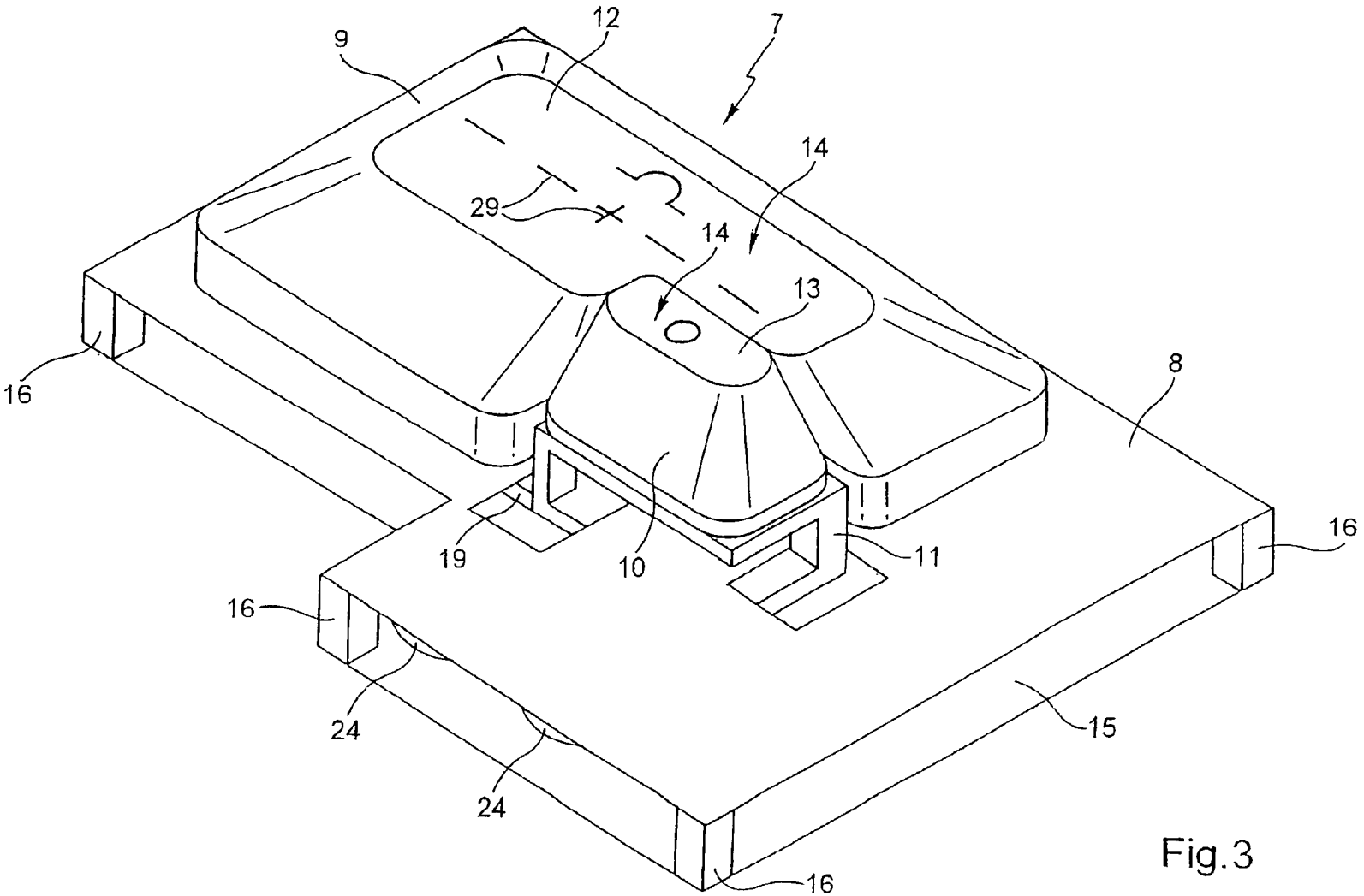
FIG. 3 is a perspective view of a pad according to the invention.

FIG. 3 represents a pad 7 adapted to be inked by the printing plate 1 and to deposit the ink on the lens 5.

The pad 7 includes a support 8 to which is fixed a first pad portion 9 made from an elastically deformable material suitable for printing ink, such as silicone, for example.

The pad 7 also includes a second pad portion 10 fixed to a mobile member 11.

The second pad portion 10 is made from the same material as the first portion 9 and the mobile member 11 is made from a rigid material.

The first pad portion 9 has a contact surface for its cooperation with the printing plate 1 and the lens 5, this surface being called the "first surface" 12. Likewise, the second pad portion 10 has a contact surface called the "second surface" 13.

The first surface 12 and the second surface 13 together form an inking surface 14. The first pad portion 9 and the second pad portion 10 also have a complementary shape so that, when these two members are placed one against the other (which is the case in FIG. 3), the first surface 12 and the second surface 13 are situated in alignment with each other to form a continuous inking surface 14.

Figure 4:
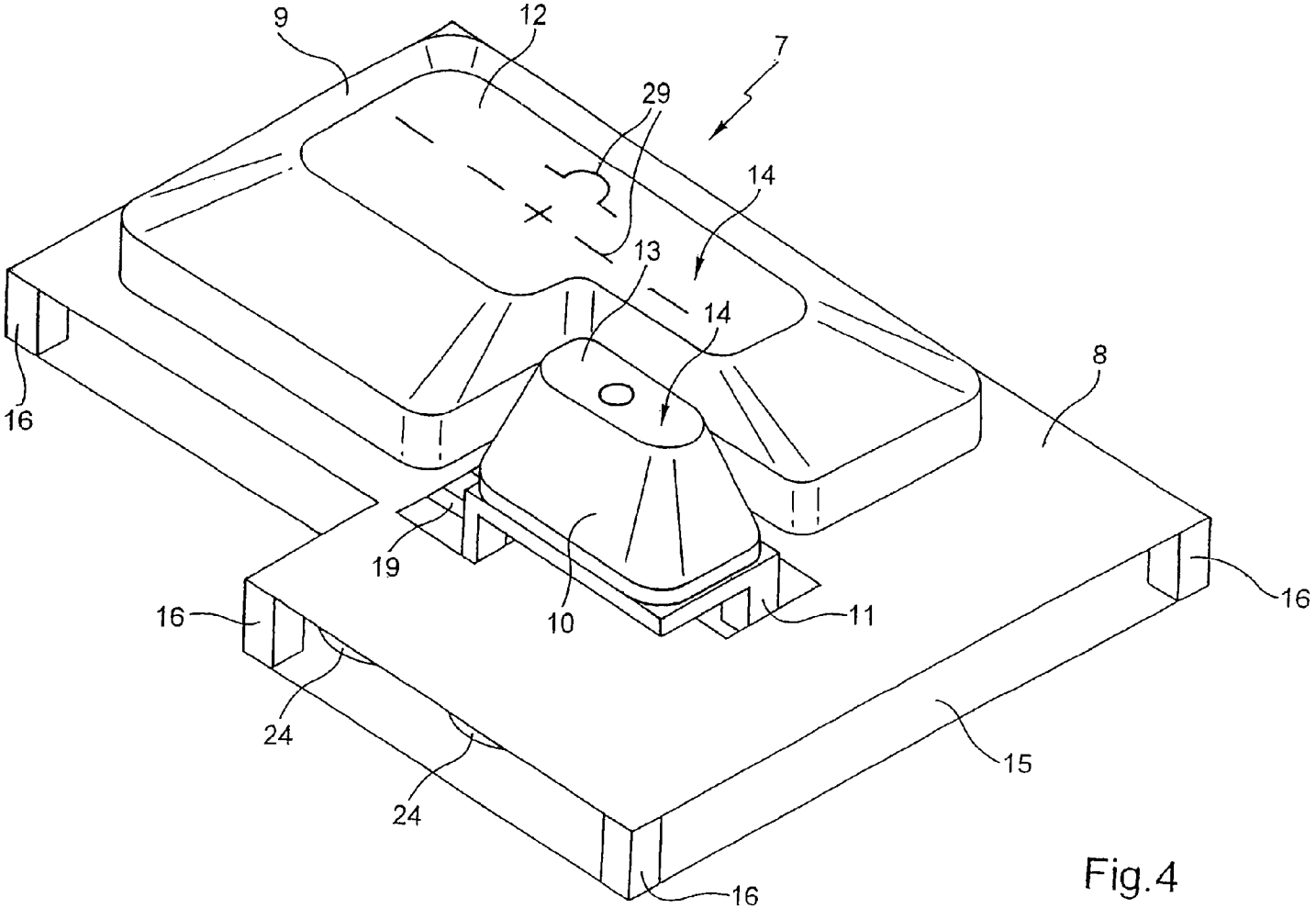
FIG. 4 is a view similar to FIG. 3, a portion of the pad having been moved away from the rest of the pad.

Conversely, in FIG. 4, the mobile member 11 having been moved, the second pad portion 10 is moved away from the first pad portion 9 so that here the inking surface 14 is discontinuous.

Figure 5:
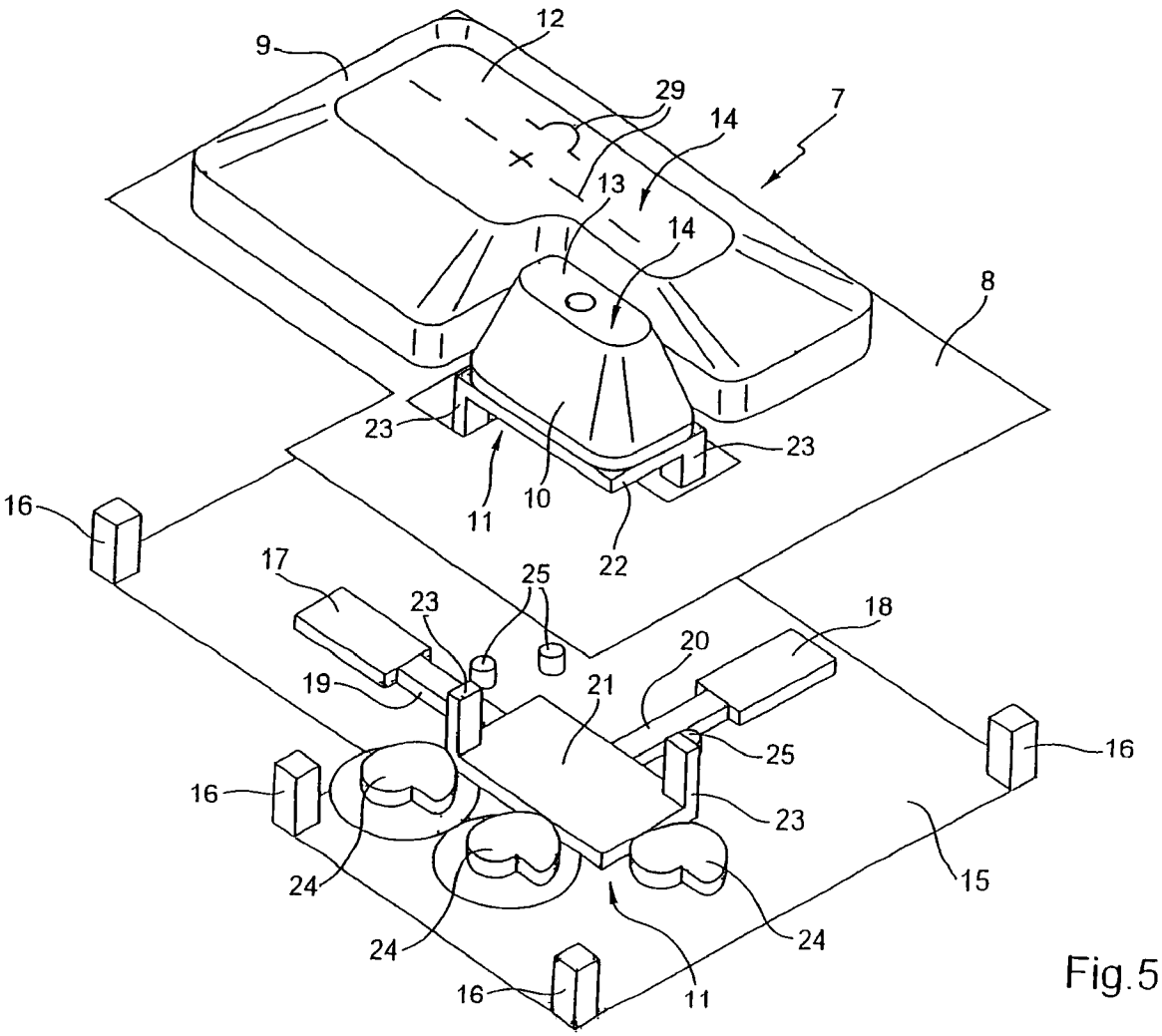
FIG. 5 is an exploded view of the pad from FIGS. 3 and 4.

The exploded view of FIG. 5 shows the mechanism for moving the mobile member 11.

The support 8 is in fact attached to a chassis 15 by a set of spacers 16. The chassis 15 is thus disposed parallel to and facing the support 8.

On this chassis 15 are disposed two jacks 17, 18 each having a mobile rod 19, 20 the end whereof is fixed to the mobile member 11.

Note that in this FIG. 5, for reasons associated with the arrangement of the exploded view, the mobile member 11 has been represented in two parts separated by a horizontal cut. The mobile member 11 is in reality as shown in FIG. 3. It is composed of two parallel walls 21, 22 held in face-to-face relationship by two spacers 23 (the imaginary cut of FIG. 5 is made through the spacers 23).

The chassis 15 further receives a set of three cams 24 each mounted to turn about an axis perpendicular to the chassis 15. Two of these cams 24 are adapted to cooperate with one of the edges of the wall 21 whereas the third cam 24 is adapted to cooperate with the adjacent edge of this wall 21, as in FIG. 5. Each of the cams 24 is driven in rotation by a motor (not shown).

To the chassis 15 there are further fixed three fixed abutments 25 disposed in the same manner as the cams 24 but on the other side of the wall 21 of the mobile member 11.

The mobile member 11 can therefore be moved between a first extreme position in which the wall 21 is disposed against the fixed abutments 25 and a second extreme position in which the wall 21 is disposed, thanks to the jacks 17, 18, against the cams 24 which form adjustable abutments.

FIGS. 6 to 11 relate to a pad according to an embodiment other than that represented in FIGS. 3 to 5, only the exterior shapes of the first pad portion 9 and the second pad portion 10 having been modified. The numbering used until now applies also to this embodiment which is functionally identical to the previous one.

Figure 6:
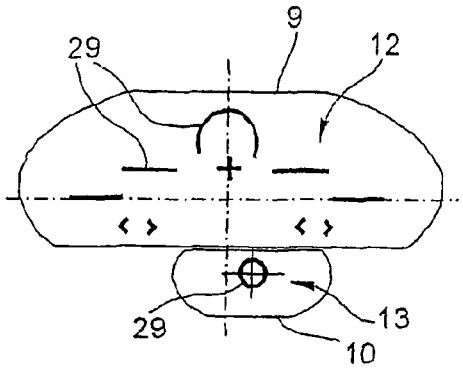
FIGS. 6 and 7 are views from above of a pad according to a different embodiment of the invention, this pad being respectively in a first position and a second position.

FIG. 6 shows the pad 7 in a position corresponding to that of FIG. 3, the second pad portion 10 being disposed against the first pad portion 9.

The mobile member 11 is then disposed against the fixed abutments 25.

Figure 7:
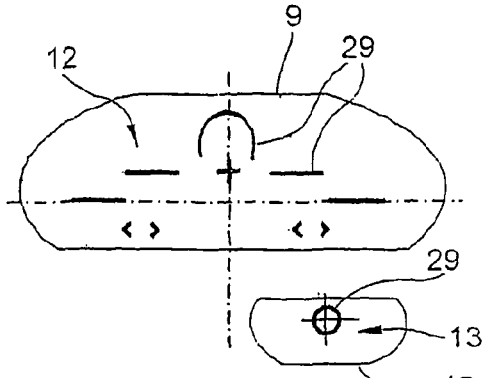

As for FIG. 7, it shows the pad 7 in a position corresponding to that of FIG. 4, the second pad portion 10 being moved away from the first pad portion 9. The mobile member 11 is at this time disposed against the cams 24.

The elements described hereinabove operate in the manner indicated hereinafter.

In FIGS. 8 to 11, the printing plate 1, the lens 5 and the pad 7 are fitted into a printing machine not shown that is well known in this type of application.

The printing plate 1 and the lens 5 are respectively positioned on supports mobile in lateral translation whereas the pad 7 is mobile in vertical translation.

Figure 8:
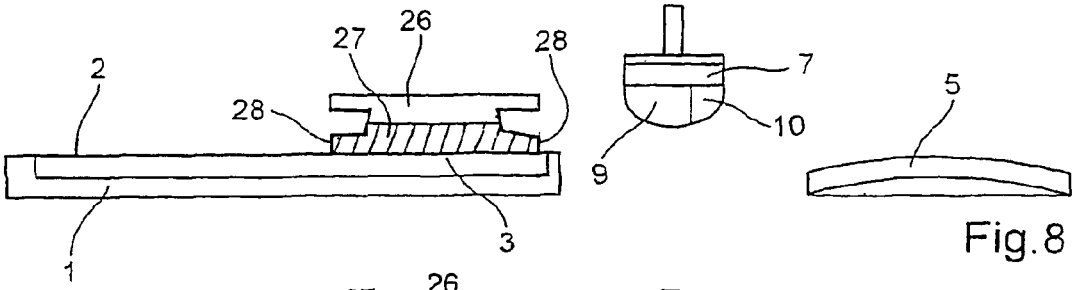
FIGS. 8 to 11 are diagrammatic profile views showing successive steps of the marking of an ophthalmic lens in accordance with the invention.

Referring to FIG. 8, the printing plate 1 is first subjected to the passage of an inking member 26 adapted to fill the engravings 4 of the printing plate 1 with ink. The inking member 26 is a bottomless tank which, when it is pressed against the surface 2 of the printing plate 1, can contain ink 27. The rim of the inking member 26 adjacent the printing plate 1 is formed by a doctor blade 28 extending all around the inking member 26.

Figure 9:
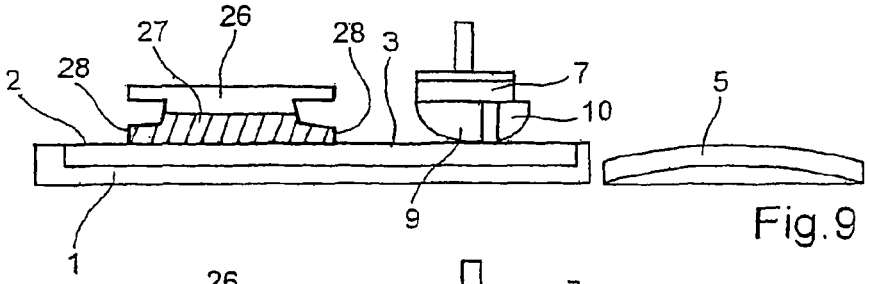

The inking member 26 is held fixed against the printing plate 1 whereas the latter, from the FIG. 8 position to the FIG. 9 position, is moved laterally in translation so that the inking member 26 is disposed in the inking area 3 of the printing plate 1 (FIG. 8) and afterwards on the surface 2 of the printing plate 1 (FIG. 9). This enables the engravings 4 to be filled with ink 27, after which the ink is wiped from the surface of the inking area 3 by the doctor blade 28 to leave ink only in the engravings 4.

The pad is then lowered onto the inking area 3 (FIG. 9). Note that although in this FIG. 9 the pad 7 is disposed against the printing plate 1 when it is in its position corresponding to FIG. 7 it may equally well undergo this operation when it is in the position corresponding to FIG. 6.

Figure 10:
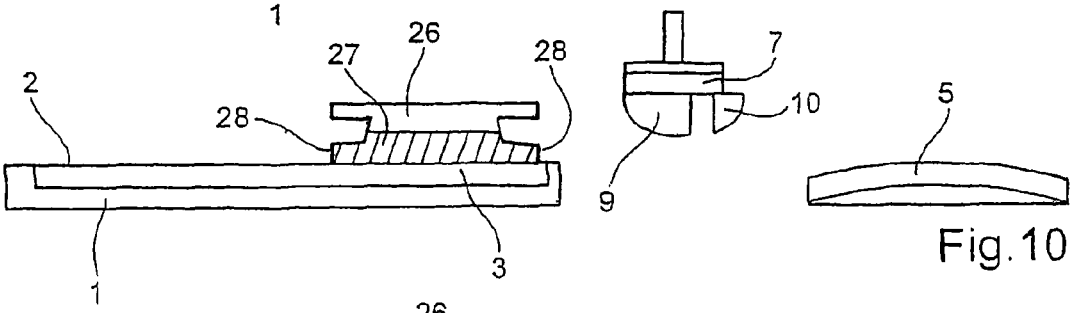

FIG. 10 shows the next step during which the pad 7 is lifted and the printing plate 1 is moved in translation to free the space available under the pad 7. The pad 7 then has on its first surface 12 and its second surface 13 the inked patterns 29 formed beforehand by the engravings 4 of the printing plate 1 and which have now adhered to the pad 7. FIG. 7 shows these inked patterns 29.

The pad 7 with the inked patterns 29 forms an inked pad. This pad may then be adjusted as a function of the relative positions to be imparted to the markings 6 when they are produced on the lens 5.

For example, in the case of FIGS. 6 and 7, the printing plate 1 and the pad 7 are such that, during the FIG. 9 step, a set of inked patterns 29 is disposed on the first surface 12 whereas a single inked pattern 29, corresponding in our example to the near vision measurement area of a progressive lens, is disposed on the second surface 13.

During the step corresponding to FIG. 10, the cams 24 are driven to form abutments such that, when the mobile member 11 is disposed against these abutments, the second surface 13 (and consequently the patterns 29 that it carries) and the first surface 12 (and consequently the patterns 29 that it carries) are in the relative position required for the type of lens 5 concerned.

The jacks 17, 18 are then operated to place the mobile member 11 against the cams 24 and thereby effect the positioning thereof.

Note that the adjustment of the cams 24 may be effected in masked time, for example during the steps corresponding to FIGS. 8 and 9.

Figure 11:
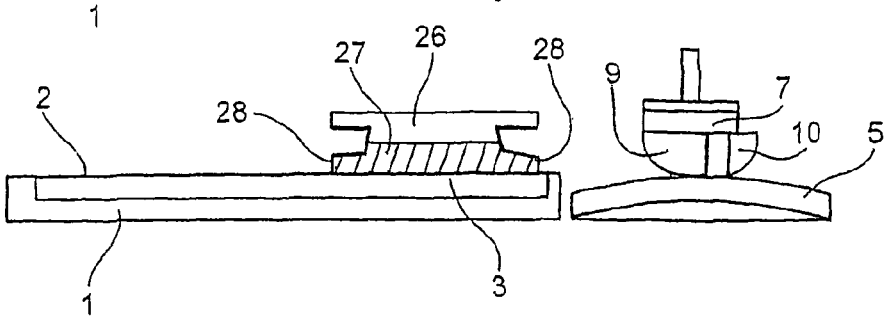

The step of FIG. 11 corresponds to the printing as such of the patterns on the lens 5. For this, the lens 5 is moved in translation under the pad 7, the latter being lowered onto the surface of the ophthalmic lens 5 to deposit thereon the inked patterns 29 that on the lens 5 will become the markings 6 visible in FIG. 2.

The aptitude of the cams 24 to form mobile abutments as well as the possibility of displacement of the mobile member 11 thus enable the forming on a lens 5 of markings 6 the unitary elements whereof are produced by the engravings 4 on the printing plate 1 but have been adapted as a function of the particular type of lens.

Figure 12:
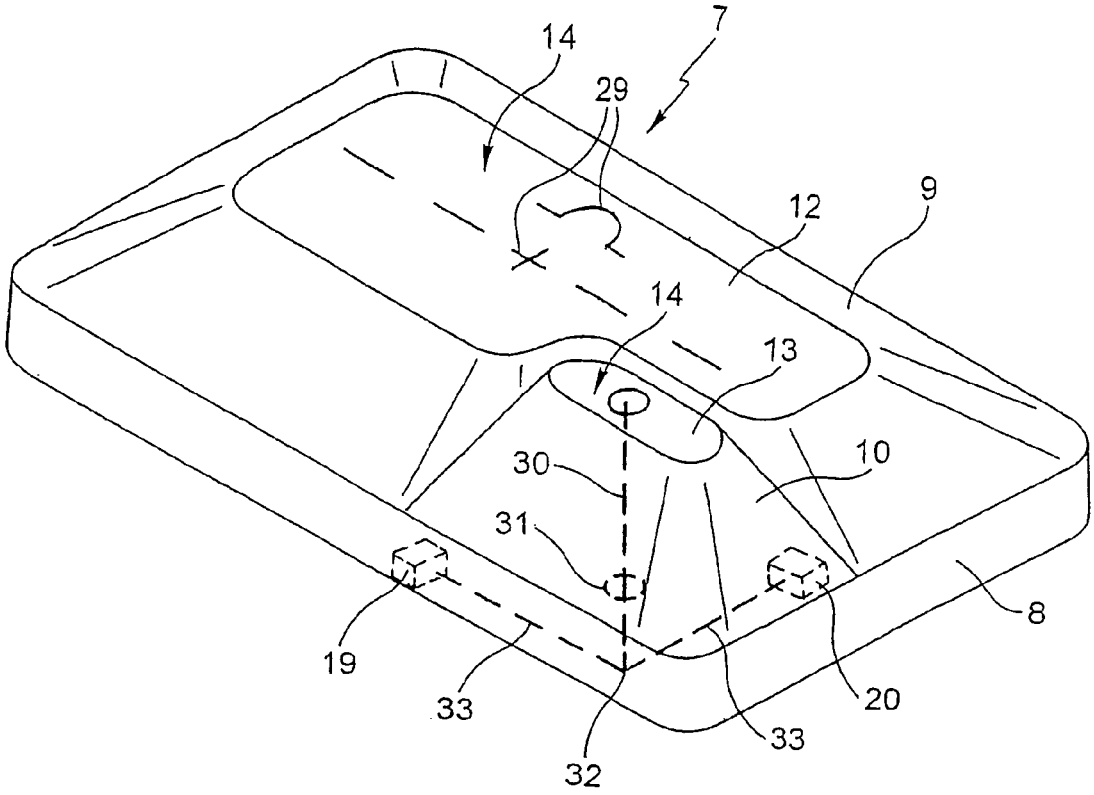
FIG. 12 is a perspective view of a pad according to an alternative embodiment of the invention.
Figure 13:
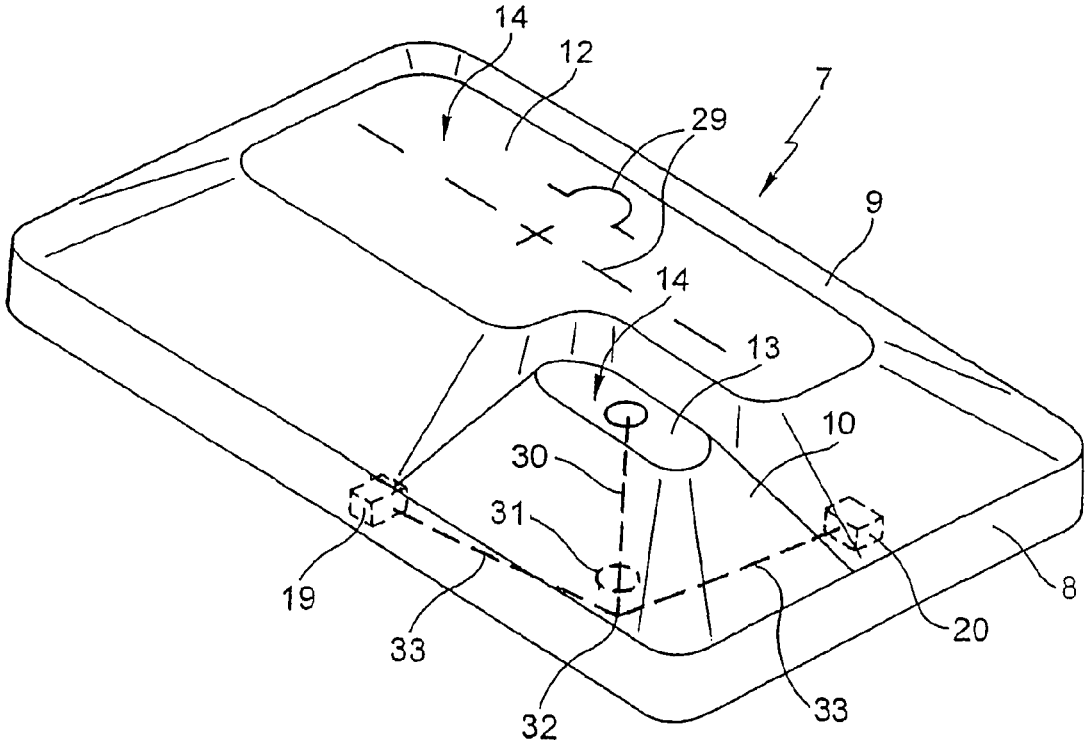
FIG. 13 is a perspective view of the pad from FIG. 12 with a portion of the pad moved away from the rest of the pad.

FIGS. 12 and 13 relate to an alternative embodiment of the pad 7. The numbering used hereinabove is retained for elements with the same function.

FIG. 12 shows a pad 7 the second pad portion 10 whereof is fixed to the support 8, like the first pad portion 9.

The second pad portion 10 includes a rigid bar 30 embedded in the material of the second portion 10. This rigid bar is also articulated in a ball-joint 31 fixed relative to the support 8.

One of the ends of the bar 30 is disposed in the vicinity of the second surface 13 whereas the other of these ends, beyond the ball-joint 31, is coupled by an articulation 32 to two transverse rigid bars 33 themselves coupled to the rods 19, 20 of two jacks fixed to the support 8.

In FIGS. 12 and 13 only the ends of the rods 19, 20 of the actuators are represented for greater clarity.

When the pad 7 is in the FIG. 12 position, its layout corresponds to that of the pad from FIG. 3, the rods 19, 20 of the jacks being deployed.

To move to the configuration corresponding to that of FIG. 4, that is to say to move the second surface 13 away from the first surface 12, the rods 19, 20 of the jacks are retracted, which causes pivoting of the bar 30 about the ball-joint 31 and consequently displacement of the end of the bar 30 close to the second surface 13 in the direction away from the first pad portion 9.

Figure 14:
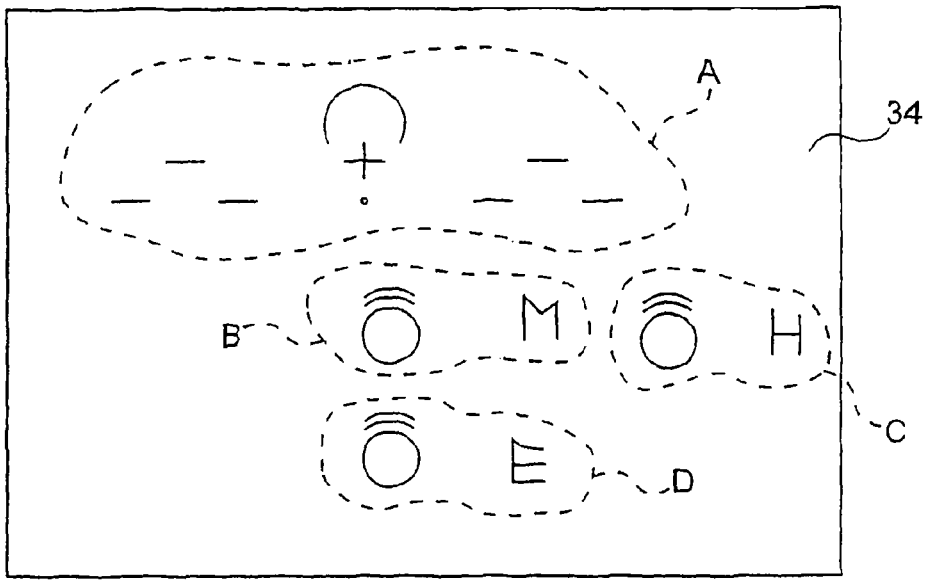
FIG. 14 represents, seen from above, a printing plate adapted to implement the method according to another embodiment of the invention.
Figure 15:
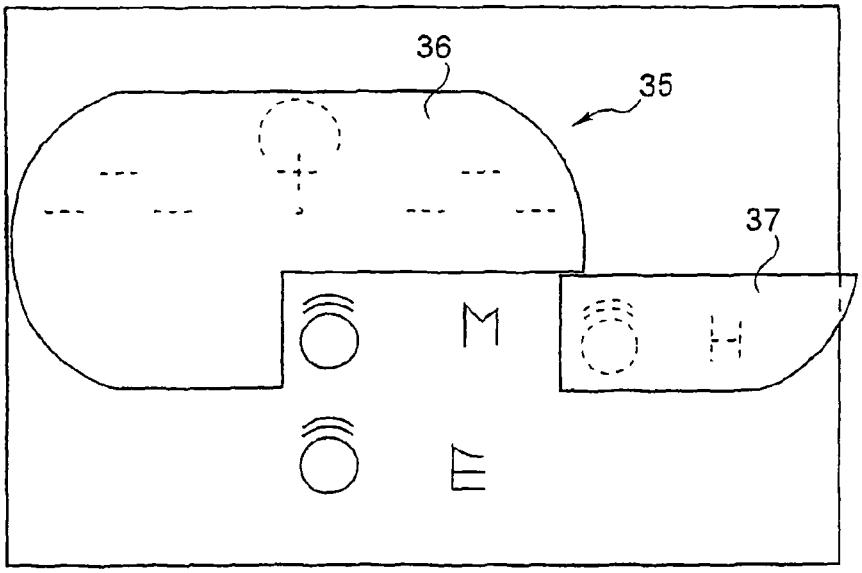
FIG. 15 represents the step of inking of a pad by the FIG. 14 printing plate.
Figure 16:
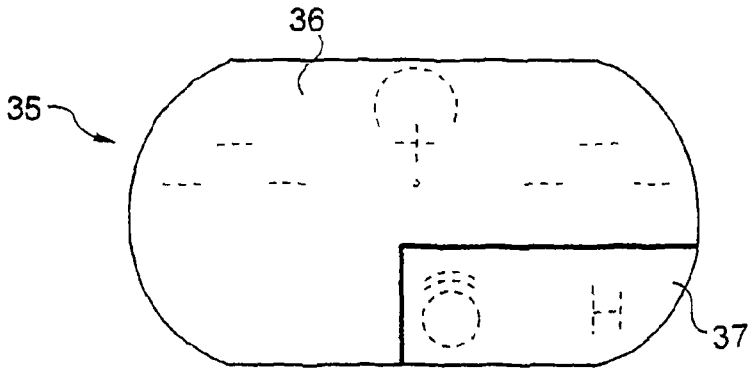
FIG. 16 is a view of the pad from FIG. 15 after the transformation step.

FIGS. 14 to 16 show another embodiment of the method according to the invention.

A printing plate 34 (see FIG. 14) is first prepared for the inking of a pad 35 (see FIG. 15). This printing plate 34 includes an area A of "common" engravings and areas B, C and D of "specific" engravings.

This printing plate 34 applies to three different types of lens respectively a first type of marking corresponding to the common area A associated with the specific area B, a second type of marking corresponding to the common area A associated with the specific area C, and a third type of marking corresponding to the common area A associated with the specific area D. This single printing plate 34 is therefore used to mark different lenses by selecting the specific areas to be associated with a common area.

After the passage of an inking member over the printing plate from FIG. 14 in a similar manner to the previous embodiments, a pad 35 undergoes a configuration phase during which its first portion 36 and its second portion 37 are positioned relative to each other so that the first portion 36 can be inked by the engravings of the area A and the second portion 37 can be inked only by one of the specific areas. In the FIG. 15 example, this is the specific area C.

FIG. 15 illustrates the operation of inking the pad 35, showing the latter disposed against the printing plate 34, the engravings of the areas A and C, which are used to ink the pad 35, being represented in dashed line through the pad 35.

The pad 35, having undergone successively a configuration step and then an inking step, thereafter undergoes a transformation step terminating in the FIG. 16 position.

FIG. 16 is a view from above of the inked pad 35 (the patterns that it carries being represented in dashed line through the pad 35) which, after this transformation step, features a predetermined arrangement of the patterns corresponding to the area A relative to the patterns corresponding to the area C. In this position, the pad 35 may then be applied to an ophthalmic lens in the same way as in the embodiments described hereinabove.

As for the example of FIGS. 15 and 16 relating to the area C, the pad 35 may undergo a configuration step in which the second portion 37 is disposed face-to-face with the area B or D, or any other group of selected engravings on the printing plate 34, to then become, by virtue of the transformation step, the inked pad 35 of FIG. 16, the second portion 37 whereof will in this case carry other patterns.

The modularity of the pad 35 being exploited both for inking the pad 35 and for application of the patterns to the ophthalmic lens, a large number of different predetermined markings may be applied to different lenses by the same printing plate 34.

Variant embodiments of the device described may be envisaged without departing from the scope of the invention. In particular, the various elements may be used in a printing machine other than that described with reference to FIGS. 8 to 11. Likewise, types of markings 6 other than those described may be produced.

The invention claimed is:

1. A method of marking an ophthalmic lens according to predetermined patterns, this method including the following steps:

providing of a plate (1) having engravings (4) reproducing said predetermined patterns according to a first arrangement;

filling said engravings (4) with a marking ink;

applying a pad (7) to the engravings (4) on said plate (1) so that the ink contained in the engraving (4) adheres to the pad (7) to form an inked pad (7) carrying said patterns according to the first arrangement;

applying of the inked pad (7) to an ophthalmic lens (5) in such a manner as to deposit thereon the ink disposed in accordance with said predetermined patterns;

wherein the method includes a prior step of preparing the pad (7) so as to delimit at least two inking portions (12, 13) mobile one relative to the other and further including, between the step of applying the pad (7) to the plate (1) and the step of applying the inked pad (7) to the lens (5), a transformation step during which the arrangement of the inking portions (12, 13) is modified by relative displacement of said inking portions (12, 13) to determine a second arrangement of said patterns whereby the patterns are deposited on the lens (5) according to the second arrangement.

2. The method according to claim 1, wherein the relative displacement of said inking portions (12, 13) is effected by displacing one of the inking portions (13) using an actuator (17, 18).

3. The method according to claim 2, wherein the second arrangement of the patterns is determined by positioning one of the inking portions (10, 11, 13) against abutments (24).

4. The method according to claim 1, wherein the second arrangement of the patterns is determined by positioning one of the inking portions (10, 11, 13) against abutments (24).

5. The method according to claim 4, it further including adjusting said abutments (24) before the positioning of said inking portion (10, 11, 13).

6. The method according to claim 5, wherein said adjusting of the abutments (24) is effected simultaneously with other steps.

7. The method according to claim 1, wherein, during the step of applying the pad (7) to the engravings (4), the inking of the pad (7) by all of said engravings (4) is effected.

8. The method according to claim 1, it further including, between the step of filling the engravings and the step of applying the pad (35) to the engravings, a configuration step during which the arrangement of the inking portions (36, 37) is modified by relative displacement of said inking portions (36, 37) to feature a predetermined inking arrangement of said patterns according to the patterns carried by the inked pad (35) are deposited according to said inking arrangement.

9. The method according to claim 8, wherein, during the step of applying the pad (35) to the engravings, the inking of the pad (35) is effected by only some of said engravings, said inking arrangement of the pad (35) enabling selection of engravings for inking the pad (35).

10. A device for marking an ophthalmic lens in accordance with predetermined patterns, the device including:

a support for receiving a plate (1) with engravings (4) reproducing said predetermined patterns according to a first arrangement;

a support for receiving an ophthalmic lens (5);

a device (26) for inking the plate (1);

a pad (7) having an inking surface (14) through which it is adapted to be moved selectively opposite the first support in an inking position or the second support in a marking position;

wherein the pad (7) includes at least two inking portions (12, 13) one inking portion being mobile relative to the other and a displacement drive member (17, 18) provided for displacing said inking portions (12, 13) between the inking position and the marking position, whereby the pad (7) is adapted to be inked with said patterns according to the first arrangement, said patterns being adapted to be disposed according to a second arrangement in the marking position.

11. The device according to claim 10, wherein a first (12) of said inking portions is coupled to a first rigid member (8) and a second (13) of said inking portions is coupled to a second rigid member (11, 30), the first rigid member (8) and the second rigid member (11, 30) being adapted to be displaced one relative to the other, and said displacement drive member (17, 18) acts on at least one of the rigid members (8, 11, 30).

12. The device according to claim 11, wherein the first inking portion (12) is mounted on a fixed support (8) and the second inking portion is mounted on a mobile support (11).

13. The device according to claim 12, wherein the mobile support (11) is adapted to be driven by an actuator (17, 18).

14. The device according to claim 13, wherein the mobile support (11) is adapted to cooperate with fixed abutments (25).

15. The device according to claim 12, wherein the mobile support (11) is adapted to cooperate with fixed abutments (25).

16. The device according to claim 12, wherein the mobile support (11) is adapted to cooperate with mobile abutments (24).

17. The device according to claim 11, wherein the first inking portion (12) and the second inking portion (13) are mounted on the same fixed support (8), the second portion (13) being made from an elastically deformable material and being coupled to a rigid bar (30) mobile relative to said fixed support (8).

18. The device according to claim 17, wherein said rigid bar (30) is attached to the fixed support (8) by a ball-joint (31).

19. The device according to claim 17, wherein said rigid bar (30) is adapted to be driven by an actuator (19, 20).

20. The device according to claim 10, wherein the first inking portion (12) and the second inking portion (13) are made of silicone.

* * * * *